US005340223A

United States Patent [19]

Herbert

[11] Patent Number: 5,340,223

[45] Date of Patent: Aug. 23, 1994

[54] MULTI-STRIKE INK RIBBON FEED CONTROL

[75] Inventor: Raymond J. Herbert, Leigh-on-Sea, United Kingdom

[73] Assignee: Neopost Limited, Essex, United Kingdom

[21] Appl. No.: 994,525

[22] Filed: Dec. 21, 1992

[30] Foreign Application Priority Data

Dec. 30, 1991 [GB] United Kingdom ..... 9127478.7

[51] Int. Cl.[5] ..... B41J 35/28

[52] U.S. Cl. ..... 400/208; 400/219; 400/249; 400/703

[58] Field of Search ..... 400/207, 207 E, 208, 400/219, 219.1, 239, 243, 249, 703, 54

[56] References Cited

U.S. PATENT DOCUMENTS

| | | | |
|---|---|---|---|
| 4,836,698 | 6/1989 | Takagi et al. | 400/208 |
| 4,907,902 | 3/1990 | Doi | 400/249 |
| 4,917,515 | 4/1990 | Piller et al. | 400/249 |
| 4,948,276 | 8/1990 | Haftmann et al. | 400/208 |

FOREIGN PATENT DOCUMENTS

| | | | |
|---|---|---|---|
| 3706307 | 5/1988 | Fed. Rep. of Germany . | |
| 0047685 | 3/1982 | Japan | 400/249 |
| 0190884 | 10/1984 | Japan | 400/208 |
| 0071285 | 4/1985 | Japan | 400/249 |
| 0190379 | 9/1985 | Japan | 400/249 |
| 0219081 | 11/1985 | Japan | 400/249 |
| 0089372 | 4/1988 | Japan | 400/239 |
| 0022972 | 1/1989 | Japan | 400/207 E |
| 1195088 | 8/1989 | Japan | 400/208 |
| 0314185 | 12/1989 | Japan | 400/207 E |
| 0022089 | 1/1990 | Japan | 400/249 |

*Primary Examiner*—Edgar S. Burr
*Assistant Examiner*—Christopher A. Bennett
*Attorney, Agent, or Firm*—Shoemaker and Mattare, Ltd.

[57] ABSTRACT

Means to control feeding of a multi-strike ink ribbon housed in a reversible cassette is disclosed. The cassette carries a magnetizable element and when the cassette is inserted in printing apparatus the element is located in operative alignment with a magnetic sensing device and with an electromagnet. Upon insertion of the cassette, the polarity of magnetization is sensed and provided the polarity is correct printing is enabled. If the polarity is incorrect printing is disabled. When the end of the ink ribbon is sensed, the electromagnet is energized to reverse the polarity of magnetization of the element so that when the cassette is removed and reinserted with reversed orientation, the correct polarity of magnetization is sensed and printing is enabled. A counter may be provided to limit the number of permitted reversals of the cassette.

6 Claims, 3 Drawing Sheets

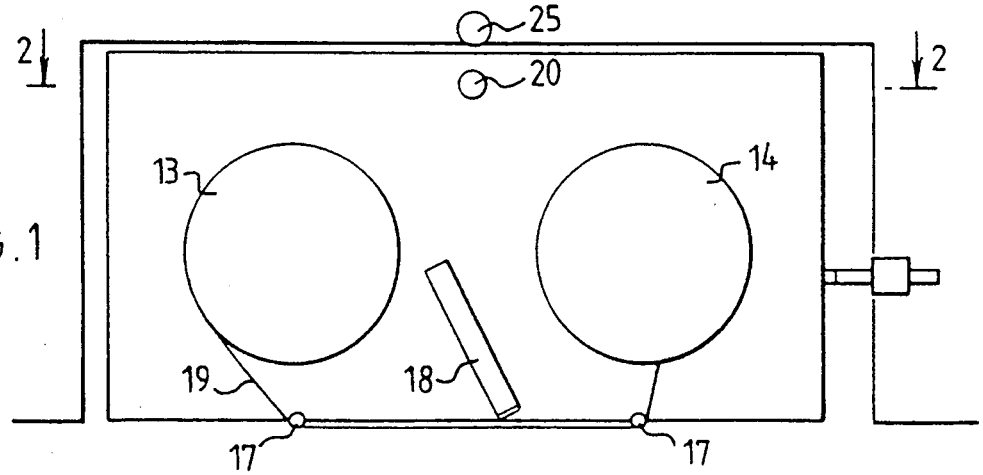
FIG.1
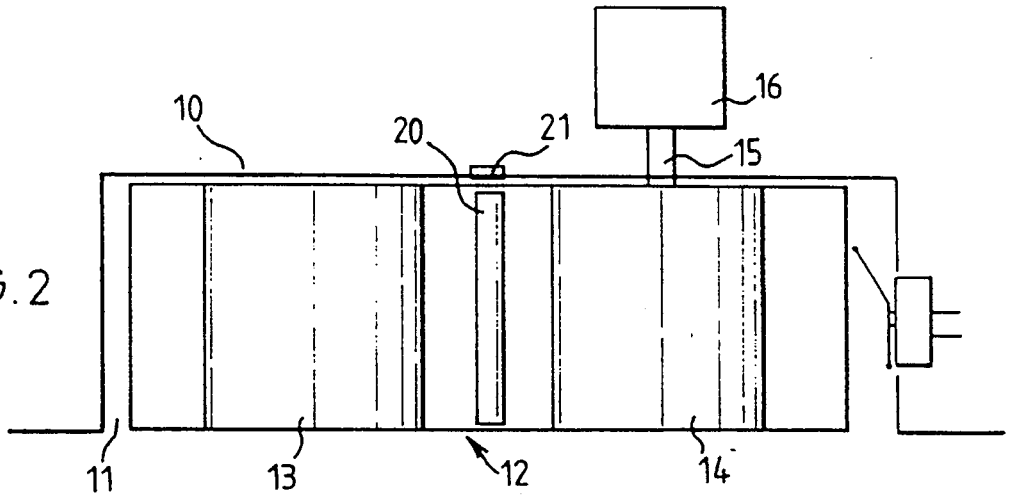
FIG.2
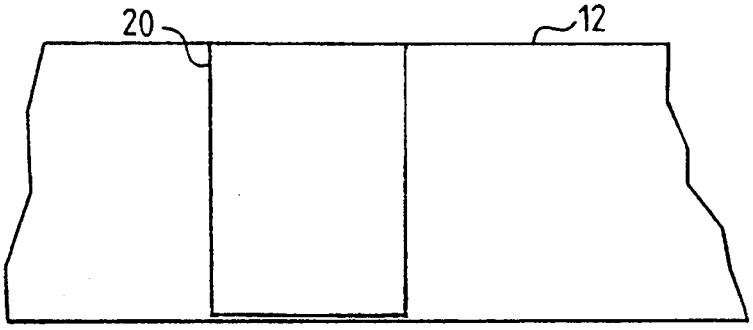
FIG.3
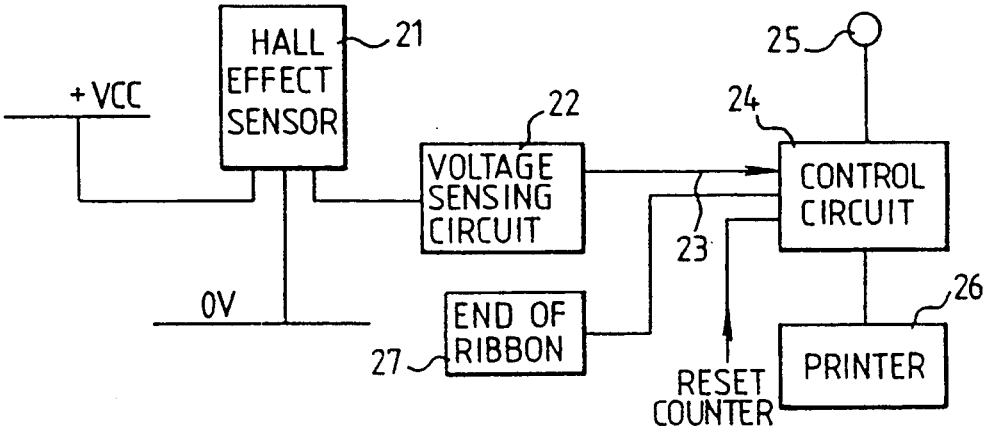

MULTI-STRIKE INK RIBBON FEED CONTROL

BACKGROUND OF THE INVENTION

This invention relates to control of the feed of multi-strike ink ribbons and in particular to the control of insertion of cassettes containing such ribbons into printing apparatus.

Multi-strike ink ribbons are ribbons in which a part of the ink is removed in a pass of the ribbon past a print head so that the ribbon may be re-used a number of times in which the ink is successively removed. In thermal ink transfer ribbons the ink is in multiple layers carried on a backing substrate and in each pass of the ribbon ink from the exposed layer is removed leaving ink in underlying layers to be removed in successive passes of the ribbon. In printing devices in which printing is carried out during feeding of an item, on which printing is to be effected, past a print head in a single direction it has been required that, when the end of the ribbon is reached after a pass of the ribbon, printing is interrupted to enable the entire ribbon to be rewound. In a multi-strike ink ribbon feed disclosed in our European patent specification 0 315 384 the disadvantage of interrupting the printing for a time sufficient to enable the ribbon to be rewound is overcome by progressively rewinding the ribbon in intervals between printing on items. However whether the entire ribbon is rewound in a single operation or is progressively rewound it is necessary to provide drive means to rotate the spool on which the ribbon is wound. Such drive means add to the cost of the equipment and furthermore occupy space so that the equipment be larger than desired.

Ink ribbons may be provided in a cassette which may be removably inserted in operative position in a printing device. The cassette usually has a supply spool filled with ribbon and an empty take-up spool onto which the used ribbon is wound, When the cassette is in operative position in the printing device, means in the printing device draws the ribbon from the supply spool past the print head of the printing device and take up spool is driven by a drive motor in the printing device to wind the used ribbon onto the take-up spool.

SUMMARY OF THE INVENTION

According to the invention multi-strike ink ribbon feed control apparatus includes a cassette housing a first spool with multi-strike ink ribbon wound thereon; a second spool to receive ribbon drawn from the first spool and used in a printing operation; a magnetized element carried by said cassette; printing apparatus to receive said cassette to enable a print head of said apparatus to effect printing operations in which ink is transferred from the ribbon to articles receiving a print impression; said printing apparatus including sensor means responsive to the magnetized element to generate a first signal in response to said cassette and element having a first orientation relative to the printing apparatus and a second signal in response to the cassette and element having a second reversed orientation with respect to the printing apparatus and control means operative in response to said first signal to permit operation of the printing apparatus and operative in response to the second signal to inhibit operation of the printing apparatus.

The invention also encompasses a ribbon cassette for use in the ribbon feed control apparatus,

BRIEF DESCRIPTION OF THE DRAWING

Embodiments of the invention will now be described by way of example with reference to the drawings in which:

FIG. 1 is a schematic side view of an ink ribbon cassette mounted on printing apparatus, FIG. 2 is a schematic sectional view on the line 2—2 of FIG. 1, FIG. 3 is a circuit diagram of a circuit for detecting orientation of the cassette.

DESCRIPTION OF THE PREFERRED EMBODIMENTS

Figure 4:
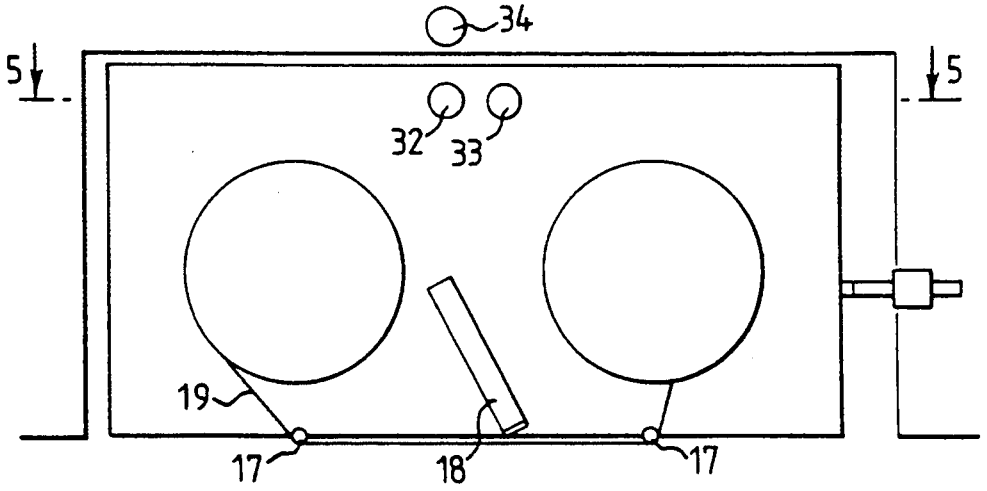
FIG. 4 is a schematic side view of a modification of FIG. 1.
Figure 5:
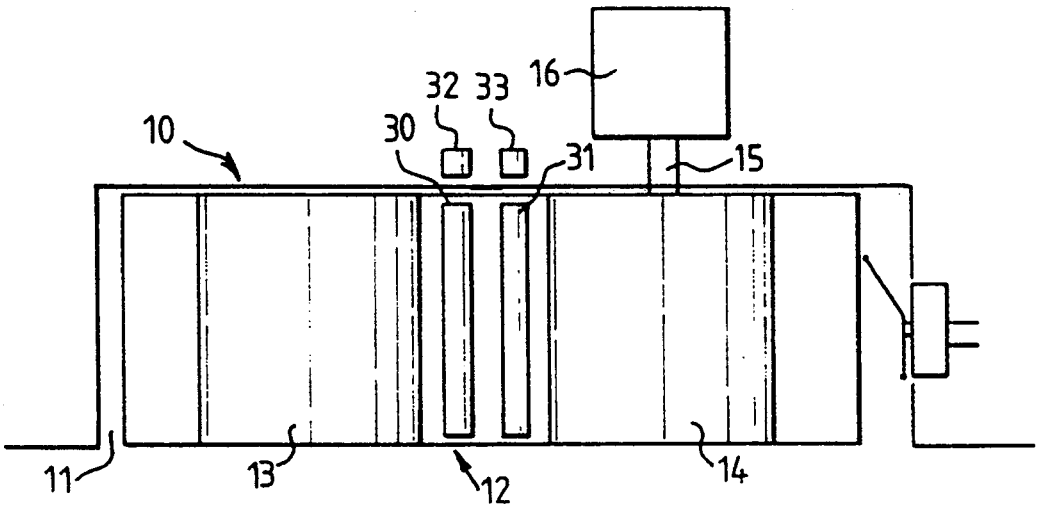
FIG. 5 is a schematic sectional view on the line 5—5 of FIG. 4.
Figure 6:
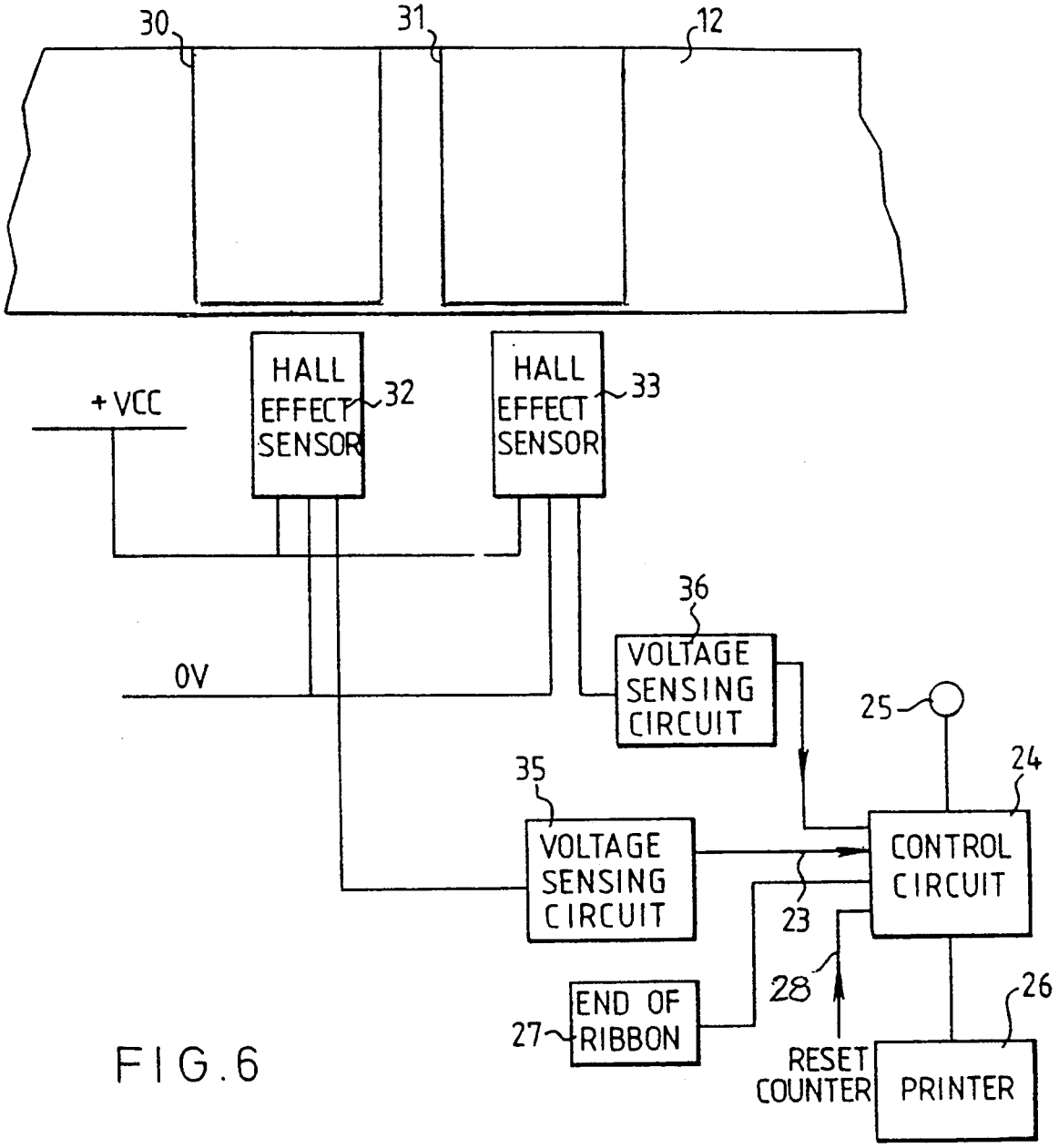
FIG. 6 is a circuit diagram of a circuit for detecting orientation of the cassette of FIGS. 4 and 5.

Referring first to FIGS. 1 and 2, a chassis 10 of printing apparatus has a recess 11 for the reception of an ink ribbon cassette 12. The cassette has a supply spool 13 filled with thermal transfer ink ribbon 19 and the ribbon extends to a take-up spool 14. When the cassette is inserted in the recess of the printing apparatus the take spool drivingly engages with a shaft 15 of a take-up motor drive 16. The ribbon between the supply spool and the take-up spool is guided by ribbon guides 17 to follow a path past a thermal print head 18. The cassette is apertured in side walls thereof to permit the print head to enter the space between the spools when the cassette is inserted in the printing apparatus. During printing operations, items on which printing is to be effected are fed past the print head and are urged by an impression roller (not shown) into ink transfer engagement with an ink layer on the ribbon and a substrate of the ribbon is urged into heat transfer relationship with the heatable elements of the print head. After passing the print head, the ribbon is peeled from the surface of the item by tension applied to the ribbon due to rotational drive by the take-up motor of the take-up spool. Accordingly as items pass the print head and receive an imprint the ribbon is successively drawn from the supply spool 13 and is wound onto the take-up spool. When the end of the ribbon on the supply spool is reached the cassette is removed and may be replaced on the printing apparatus with reverse orientation so that the spool which was the take-up spool and on which the entire ribbon is now wound becomes the supply spool and the spool which was the supply spool and has become empty becomes the take-up spool. This removal, reversal and re-insertion of the cassette may be repeated a number of times until the ink layers of the multi-strike ribbon have been depleted.

However it will be appreciated that a user of the printing apparatus may in error replace the cassette In the printing apparatus with the same orientation as in its previous insertion or may continue to re-insert the cassette with reversed orientations after the ink layers have been depleted. For many forms of printing apparatus this would merely be an inconvenience and would lead to poor quality printing which could be remedied by repeating the printing process with a new ribbon. However in postage franking apparatus this could result in mall items passing through the apparatus without receiving a clear and perceivable franking impression. Accordingly for such apparatus it is desirable to provide means which prevent or at least warn an operator that the cassette has an incorrect orientation or has been used to a predetermined limit.

For this purpose a magnetizable element 20 is provided in or on the cassette. Initially the element 20 is magnetized with a predetermined first polarity. The printing apparatus is provided with a sensor 21, which may be a Hall effect device, which responds to the magnetization of the element of a cassette inserted in the printing apparatus. As shown in the circuit diagram of FIG. 3, the Hall effect device 21 is powered by connections to zero volt (0 V) and positive power (+VCC) lines and has an output connected to a voltage sense circuit 22. An output 23 of the circuit 22 is connected to a control circuit 24 which may be a microprocessor. When the element 20 magnetized with the initial polarity of magnetization and the cassette is inserted with the correct orientation in the chassis of the printing apparatus such that the spool full of unused ribbon is positioned as a supply spool, the output of the device 21 causes the voltage sensor circuit to produce a first signal on output line 23 to the control circuit 24. However if the cassette is inserted with incorrect orientation, the polarity of magnetization of the element 20 will be reversed relative to the sensor device 21 and this will cause the voltage sensor circuit to output a second signal to the control circuit. In response to receipt of the second signal the control circuit inhibits operation of the printing apparatus 26 for printing and preferably causes display of an error message to an operator of the apparatus.

An electromagnet 25 is located on the chassis of the printing apparatus adjacent the magnetizable element 20 of an inserted cassette 12. The electromagnet is normally unenergized. Energization of the electromagnet is controlled by the control circuit 24. When the end of the ribbon is reached, i.e. substantially the entire length of ribbon is wound onto the take-up spool and the supply spool is empty, an end of ribbon sensor 27 inputs a signal to the control circuit and the control circuit energizes the electromagnet to remagnetize the element 20 with a polarity reversed compared with the previous polarity of magnetization. Thus when the cassette is removed and reinserted with reverse orientation, the positions of the spools will be interchanged and the reversed polarity of magnetization of element 20 will correspond, relative to the chassis of the printing apparatus, to its initial polarisation and be detected by the sensor device 21 to cause the circuit 22 to output the first signal to the control circuit. Accordingly the printing apparatus will be operative. However if the cassette were to be reinserted without reversal of its orientation the polarity of magnetization of the element 20 would be sensed as being reversed and the control circuit would inhibit operation of the printing apparatus 26.

The control circuit 24 may include a counter which is reset to zero by a reset input 28 generated for example by manual operation of a key by the operator when a new unused ribbon cassette is inserted and the counter is incremented each time the sensor 21 detects that the cassette is re-inserted with reversed orientation. The control circuit will include means to check the count registered by the counter and when it reaches a value corresponding to a limit to re-use of the ribbon the control circuit inhibits further operation of the printing apparatus until a new cassette is inserted and the counter is reset. As described hereinbefore the electromagnet is energized when the end of ribbon is reached in order to reverse polarity of magnetization of the element 20. However when the counter detects that the limit of re-uses of the ribbon has been reached the electromagnet is not energized and hence the element will remain magnetized with a polarity which prevents the printing apparatus accepting the cassette for further use.

It is to be understood that the end of ribbon detector is provided in the printing apparatus to determine when the end of the ribbon has been reached in unwinding from one of the spools and the end of ribbon detector provides an end of ribbon indication to the control circuit 24.

In a modified embodiment two magnetizable elements 30, 31 are provided on the ribbon cassette. Initially, prior to use of the cassette, both magnetizable elements 30, 31 are magnetized with a predetermined polarity. Upon first insertion of the cassette into the chassis of the printing apparatus, the polarity of magnetization of both elements is sensed by sensors 32, 33 and upon sensing of the predetermined polarity of magnetization of both elements the counter of the control circuit is reset to zero and one element, for example element 30, is magnetized by an electromagnet 34 to reverse its polarity of magnetization. Thereafter the polarity of magnetization of both elements 30, 31 remains unchanged. It will be appreciated that two sensor devices 32, 33 are provided for sensing the two magnetizable elements 30, 31. On sensing the polarity of magnetization of the elements, the sensed polarity is retained either by the voltage sense circuits 35, 36 or by the control circuit 24. When the cassette is removed and re-inserted the polarity of magnetization of both elements is sensed and if the sensed polarity is reversed as compared with the sensed polarity retained from the previous insertion of the cassette an indication is provided that the cassette has been reversed. However if the sensed polarity is not reversed it indicates that the cassette has not been reversed and operation of the printing apparatus 26 is inhibited until the cassette has been re-inserted with reversed orientation.

The magnetizable element 20 and elements 30, 31 are illustrated schematically as rod like elements. However they may be of other form and may comprise a length of magnetizable tape, such as magnetic recording tape utilised for recording signals, and may be secured to a surface of the cassette by adhesive. It will be appreciated that the sensor devices 21, 32, 33 are located at a position on the chassis of the printing apparatus such that each sensor is responsive to the polarity of magnetization of the element adjacent thereto. Also the electromagnet 25 or 34 is so located as to be able to reverse the polarity of magnetization of the element adjacent thereto.

Instead of providing a magnetizable element or elements on the cassette, the thermal transfer ink ribbon may carry a magnetizable element in the form of a magnetizable ribbon at each end of the thermal ink ribbon. When the magnetizable ribbon is drawn from the spool it passes a sensor which is responsive to the magnetization of the ribbon.

As described hereinbefore the magnetizable element is magnetized such that the whole element is magnetized with a desired polarity of magnetization. However if desired the element may be magnetized with a code representation which signifies the number of times the cassette has been reversed. Each time the cassette is reversed the code is incremented to signify the updated number of reversals of the cassette. The electromagnet 25 includes a number of sections which may be selectively energized to magnetize the element 20 with the code representation and the sensor 21 is responsive to the code representation.

I claim:

1. Multi-strike ink ribbon feed control apparatus including a cassette housing; a supply spool located in said cassette housing; a multi-strike ink ribbon wound on said supply spool; a take-up spool located in said cassette housing to receive multi-strike ink ribbon drawn from the supply spool during printing operations; a magnetized element carried by said cassette housing; printing apparatus receiving said cassette housing and operable to effect the printing operations in which ink is transferred from said multi-strike ink ribbon to articles receiving a print impression; said printing apparatus including sensor means responsive to polarity of magnetization of said magnetized element to generate a first signal in response to said cassette housing and magnetized element having a first orientation relative to said printing apparatus and a second signal in response to said cassette housing and magnetized element having a second reversed orientation with respect to said printing apparatus and including control means operative in response to said first signal to permit operation of said printing apparatus and operative in response to said second signal to inhibit operation of said printing apparatus; said printing apparatus including magnetization means operable to reverse the polarity of magnetization of the magnetized element; and wherein said control means is operative in response to the multi-strike ink ribbon being substantially unwound from the supply spool and wound onto the take-up spool to operate said magnetization means to reverse the polarity of magnetization of said magnetized element.

2. Feed control apparatus as claimed in claim 1 wherein the control means includes a counter incremented in response to generation of each first signal.

3. Feed control apparatus as claimed in claim 2 wherein the control means is operative to inhibit operation of the printing apparatus in response to a predetermined value of count registered by said counter.

4. Multi-strike ink ribbon feed control apparatus as claimed in claim 1 wherein the control means includes a counter incremented in response to generation of each first signal and said control means is operative to inhibit operation of said magnetization means in response to a predetermined count value registered by said counter.

5. Multi-strike ink ribbon feed control apparatus including a cassette housing; a supply spool located in said cassette housing; a multi-strike ink ribbon wound on said supply spool; a take-up spool located in said cassette housing to receive multi-strike ink ribbon drawn from the supply spool during printing operations in which ink is transferred from said multi-strike ink ribbon to articles receiving a print impression; a magnetized element carried by said cassette housing; printing apparatus receiving said cassette housing and operable to effect the printing operations; said printing apparatus including magnetization means comprising a plurality of sections selectively operable to reverse the polarity of magnetization of selected sections of the magnetized element; said printing apparatus including sensor means responsive to magnetization of said magnetized element to generate a first signal in response to said cassette housing and magnetized element having a first orientation relative to said printing apparatus and a second signal in response to said first signal to housing and magnetized element having a second reversed orientation with respect to said printing apparatus and control means operative in response to said first signal to permit operation of said printing apparatus and operative in response to said second signal to inhibit operation of said printing apparatus; and wherein said control means is operative in response to the multi-strike ink ribbon being substantially unwound from the supply spool and wound onto the take-up spool to operate selectively said magnetization means.

6. Multi-strike ink ribbon feed control apparatus including a cassette housing; a supply spool locate din said cassette housing; a multi-strike ink ribbon wound on said supply spool; a take-up spool located in said cassette housing to receive multi-strike ink ribbon drawn from the supply spool during printing operations in which ink is transferred from said multi-strike ink ribbon to articles receiving a print impression; a first magnetized element carried by said cassette housing and initially magnetized with a first polarity of magnetization; a second magnetized element carried by said cassette housing and initially magnetized with a second polarity of magnetization; printing apparatus receiving said cassette housing and operable to effect the printing operations; said printing apparatus including sensor means operative to sense and to retain an indication of polarity of magnetization of said first magnetized element and of said second magnetized element; magnetization means operable to reverse said first polarity of magnetization of said first magnetized element; control means including a counter; said control means being responsive to said sensor means when the cassette housing is received by the printing apparatus to reset the counter and to operate the magnetization means if the first magnetized element is magnetized with said first polarity of magnetization and the second magnetized element is magnetized with said second polarity of magnetization and thereafter generating a first signal if the magnetization of first and second magnetized elements sensed by said sensor means is of reversed polarity compared with the magnetization thereof sensed upon a preceding reception of the cassette housing by the printing apparatus and generating a second signal if the magnetization of first and second magnetized elements sensed by said sensor mean sis of the same polarity as compared with the magnetization thereof sensed upon a preceding reception of the cassette housing by the printing apparatus and said control means being operative in response to generation of said first signal to permit operation of said printing apparatus and operative in response to generation of said second signal to inhibit operation of said printing apparatus.

* * * * *